US006177028B1

(12) United States Patent
Kanda et al.

(10) Patent No.: US 6,177,028 B1
(45) Date of Patent: Jan. 23, 2001

(54) SPONTANEOUS FIRING EXPLOSIVE COMPOSITION FOR USE IN A GAS GENERATOR FOR AN AIRBAG

(75) Inventors: Takeshi Kanda; Nobuaki Yokote; Takashi Saso; Koji Tanaka; Akihiko Kuroiwa; Yuji Ito; Ayumu Kimura, all of Himeji (JP)

(73) Assignees: Nippon Kayaku Kabushiki-Kaisha, Tokyo; Kabushiki Kaisha Kobe Seiko Sho, Kobe, both of (JP)

( * ) Notice: Under 35 U.S.C. 154(b), the term of this patent shall be extended for 0 days.

(21) Appl. No.: 09/077,299

(22) PCT Filed: Nov. 29, 1996

(86) PCT No.: PCT/JP96/03493

§ 371 Date: Jun. 1, 1998

§ 102(e) Date: Jun. 1, 1998

(87) PCT Pub. No.: WO97/20786

PCT Pub. Date: Jun. 12, 1997

(30) Foreign Application Priority Data

Dec. 1, 1995 (JP) ..... 7-337944
Sep. 26, 1996 (JP) ..... 8-277066

(51) Int. Cl.[7] ..... C01B 13/00; C06B 43/00; C06B 31/02; C06B 45/02; F42B 1/00; B60R 21/16

(52) U.S. Cl. ..... 252/186.2; 149/36; 149/37; 149/61; 149/62; 149/88; 149/110; 102/289; 102/288; 102/324; 280/741

(58) Field of Search ..... 149/36, 37, 45, 149/41, 46, 47, 61, 62, 74, 88, 110; 102/288, 289, 290, 324; 280/741, 740; 252/186.1, 186.2

(56) References Cited

U.S. PATENT DOCUMENTS

| | | | | |
|---|---|---|---|---|
| 4,948,439 | * | 8/1990 | Poole et al. | 149/46 |
| 5,139,588 | * | 8/1992 | Poole | 149/61 |
| 5,143,567 | * | 9/1992 | Taylor et al. | 149/35 |
| 5,198,046 | * | 3/1993 | Bucerius et al. | 149/61 |
| 5,514,230 | * | 5/1996 | Kandhadia | 149/36 |
| 5,661,261 | * | 8/1997 | Ramaswamy et al. | 149/36 |
| 5,739,460 | * | 4/1998 | Knowlton et al. | 102/324 |
| 5,773,754 | * | 6/1998 | Yamato | 149/36 |
| 5,779,267 | * | 7/1998 | Jordan et al. | 280/741 |
| 5,817,972 | * | 10/1998 | Butt et al. | 149/109.2 |
| 5,844,164 | * | 12/1998 | Cabiera | 102/288 |

OTHER PUBLICATIONS

JP, 7–223890, A (Nippon Koki Co., Ltd. et al.) Aug. 22, 1995.*

JP, 06227884,A (Nippon Koki Co., Ltd. et al.) Aug. 16, 1994.*

JP, 06238683, A (Daicel Chemical Industries, Ltd (Aug. 30, 1994).*

JP, 5–879,A (Nippon Kayaku Co., Ltd.) Jan. 8, 1993.*

* cited by examiner

*Primary Examiner*—Joseph D. Anthony
(74) *Attorney, Agent, or Firm*—Oblon, Spivak, McClelland, Maier & Neustadt, P.C.

(57) ABSTRACT

A spontaneous firing explosive composition for use in a gas generator for an airbag containing a fuel, an oxidizer, a combustion modifier, and a binder.

14 Claims, 11 Drawing Sheets

Fig. 3

40-cc tank test results

| Test No. | Enhancer | Exothermic value | 40cc $P_m$ |
|---|---|---|---|
| 01 | Prior art ($BKNO_3$) | 4.6KJ/gr | 850psi |
| 02 | Invention (Note 1) | 3.4KJ/gr | 1000psi |

Note 1): 5-ATZ: 34.2wt%, $KNO_3$: 56.8wt%, $MoO_3$: 4.5wt%, synthetic hydrotalcite: 4.5wt%

Fig. 5

60-liter tank test results

| Test No. | Composition of enhancer/ gas generating agent | | Condition A 400mm² | Condition B 200mm² |
|---|---|---|---|---|
| 03 | Fuel: 5-ATZ<br>Oxidizing agent: $KNO_3$<br>Combustion catalyst: $MoO_3$<br>Binder: hydrotalcite | $P_m$ | 153kPa | 220kPa |
| | | $t_m$ | 87ms | 47ms |
| | | Combustion | Complete | Complete |
| 04 | Fuel: K-5ATZ<br>Oxidizing agent: $KNO_3$<br>Combustion catalyst: $Fe_2O_3$<br>Binder: acid clay | $P_m$ | 148kPa | 190kPa |
| | | $t_m$ | 122ms | 85ms |
| | | Combustion | Complete | Complete |

Fig. 7

60-liter tank test results

| Test No. | | Enhancer | Gas generating agent | | Condition 100mm² |
|---|---|---|---|---|---|
| 05 | Fuel:<br>Oxidizing agent:<br>Combustion catalyst:<br>Binder: | 5-ATZ<br>$KNO_3$<br>$MoO_3$<br>Hydrotalcite | 5-ATZ<br>$Sr(NO_3)$<br>-<br>Hydrotalcite | $P_m$ | 185kPa |
| | | | | $t_m$ | 65ms |
| | | | | Combustion | Perfect |

Fig. 9

Firing waiting time test

| Test No. | Composition | | Results | Average firing waiting time | Spontaneous firing function |
|---|---|---|---|---|---|
| 06 | Same enhancer as for Test No. 02 (invention product) | 1 | 1min. 23sec. | 1min. 20sec. | Yes |
| | | 2 | 1min. 15sec. | | |
| | | 3 | 1min. 22sec. | | |
| 07 | Same enhancer as for Test No. 04 (invention product) | 1 | 2min. 21sec. | 2min. 28sec. | Yes |
| | | 2 | 2min. 45sec. | | |
| | | 3 | 2min. 18sec. | | |
| 08 | Same enhancer as for Test No. 01 (prior art $BKNO_3$) | 1 | No firing within 10 minutes | No firing (within 10 minutes) | No |
| | | 2 | same as above | | |
| | | 3 | same as above | | |
| 09 | Same gas generating agent as for Test No. 05 (other composition) | 1 | No firing within 10 minutes | No firing (within 10 minutes) | No |
| | | 2 | same as above | | |
| | | 3 | same as above | | |

Fig. 10

Bonfire test results

| Test No. | Composition | | Firing waiting time | Housing damage |
|---|---|---|---|---|
| | Enhancer | Gas generating agent | | |
| 10 | Same as for Test No. 03 1.5g (invention product) | Same as for Test No. 03 36.0g (invention product) | 1min. 16sec. | No |
| 11 | Same as for Test No. 03 1.5g (invention product) | Same as for Test No. 05 36.0g (other composition) | 1min. 31sec. | No |
| 12 | Same as for Test No. 01 1.2g (prior art $BKNO_3$) | Same as for Test No. 05 36.0g (other composition) | 6min. 25sec. | Filter broken, housing deformed and cracked |

SPONTANEOUS FIRING EXPLOSIVE COMPOSITION FOR USE IN A GAS GENERATOR FOR AN AIRBAG

TECHNICAL FIELD

The present invention relates to a gas generating agent and a enhancer for use in a gas generator to inflate an air bag for protection the occupant in a vehicle and a gas generator using aforesaid gas generating agent and enhancer. More specifically, this invention relates to an enhancer which has a spontaneous firing function and is safe-to-handle. And the enhancer is especially excellent in the properties required in the ignition agent for gas generating agents and of which composition is can also be used as gas generating agent itself. Further, this invention relates to a gas generator which is provided with an excellent spontaneous firing function to use aforesaid enhancer of which composition can also be used as gas generating agents.

BACKGROUND OF THE INVENTION

As dissolved by U.S. Pat. No. 4,547,342 and FIG. 11, the gas generator that has been generally used, comprises a housing 1 with an upper container body 2 and a lower container body 3. The upper container body 2 has an inner cylinder wall 4 and an outer cylinder wall 6 with an intermediate cylinder wall 5 there-between and the lower container body 3 has faces which are butted on the lower end portions of the cylinder walls respectively and friction-welded so that the upper container body 2 and the lower container body 3 may become into a unit. An ignition chamber 7 is formed inside the inner cylinder wall 4 in the housing 1. A combustion chamber G is formed between the inner cylinder wall 4 and the intermediate cylinder wall 5. A filter chamber F is formed between the intermediate cylinder wall 5 and the outer cylinder wall 6. And the inner cylinder wall 4 is provided with first gas holes 4*a*, the intermediate cylinder wall 5 is provided with second gas holes 5*a* and the outer cylinder wall 6 is provided with gas release holes 6*a*. In the ignition chamber 7, an igniter 9 and enhancer 10 are placed. Inside the combustion chamber G, gas generating agent 11 and a first filter 12 are arranged in the radial direction in that order. In the filter chamber F, a regulation plate 13 and second and third filters 14, 15 are mounted in that order. The regulation plate 13 is bent at its upper end to contact with the upper inner surface of the container 1 and seal the upper portion, and has a gas holes 13*a* so that the gas from the combustion chamber G is led downward along the regulation plate 13 into the filter chamber F through the gas hole 13*a*.

Upon crash of a motor vehicle, the sensor detects the impact and sends an activate signal to an electric detonator taking a roll of an igniter 9.

Then, the enhancer 10 is ignited by the flame from the igniter 9. Large quantity of heat particle current is generated by the enhancer 10 in turn flows into the combustion chamber G through the first gas holes 4*a* (as indicated by an arrow in the drawing) and fires the gas generating agent 11. The gas generating agent bursts out into flame then high-temperature gas containing slug is produced. This gas cools down during passing through the first filter 12, then flows into the filter chamber F through the second gas holes 5*a* and goes downward along the regulation plate 13. The gas then passes through the gas holes 13*a* and goes upward along the second filter 14, and passes through the second filter 14 and the third filter 15 while the gas is cooled and cleared of slug. Lastly, the gas becomes clear with a proper temperature and is discharged into the air bag (not shown in the drawing) through the gas release hole 6*a*.

The enhancer 10 used in the aforesaid gas generator takes a roll of a combustion improver to fire the gas generating agent 11, which is basically different from the gas generating agent 11.

There is boron niter ($BKNO_3$) as one of the enhancers, which have been generally used. It is considered that a process of transfering fire proceeds as follows. The gasification percentage of boron niter is about 10 percent. Therefore, when the igniter 9 ignites boron niter, the heated metal oxide particles are dispersed into the combustion chamber G with a generated heated gas current. Then, the heated metal oxide particles stick on the surface of the gas generating agent 11. The gas generating agent 11 starts to burn at the struck spots. When the gas generating agent 11 is an organic type (so-called a non-azide type), the stuck spots, in other words, the heated areas of the gas generating agent, are firstly softened and melted then vaporized. Consequently, combustion reaction are started at the stuck spots. Further, at the portions surrounding the the stuck spots, combustion reactions are successively occurred by combustion heat from the the stuck spots in the same manner. Thus, the combustion reaction broadens rapidly.

The combustion of the gas generating agent at an initial stage can be regarded as local combustions at the spots on which the heated boron particles stick. Therefore, in order to increase the initial firing area of the gas generating agent, it is suggested to assure making space among of pellets of the gas generting agent so as to increase area on which the heated boron particles stick. The space among of the gas generating agent pellets plays a roll of a passage for the heated boron particles passing through. However, according to this way, the packing percentage of the gas generating agent pellets decreases and a larger size gas generator is required. This is contrary to the trend of size and weight reductions.

Also, when the packing density of the gas generating agent is raised so as to reduce size and weight of the gas generator, it is difficult for the heated boron to stick to the pellets of the gas generating agent uniformly and it hard to adjust the combustion velocity.

Further, when a car which has met with no accident, is treated to abandon, the gas generator is remove from an air bag module and incinerated since it is difficult to pick up the only gas generating agent from the air bag module. While the incineration of the gas generator, the housing of the gas generator is heated and becomes so brittle. In this time, the gas generator may explode and break because of combution of the gas generating agent, which can bring danger to the neighboring area. Also, this kind of danger may occur in other case than the incineration, for example, when a car catches fire at accident other than a collision. Therefore, nowadays, such spontaneous firing explosive as shown in U.S. Pat. No. 4,561,675 is proposed in order to preclude the above danger. The spontaneous firing explosive is dispoed inside the housing of the gas generator to separate from the gas generating agent and the enhancer, and is spontaneously fired before the housing deterioration due to high temperature. In other words, the spontaneous firing explosive is spontaneously fired at one temperature which is lower than another temperature at which the housing deteriorates. In placed of the igniter 9, the spontaneous firing explosive ignites the gas generating agent in the gs generator. However, this method has a problem that the fourth material like a spontaneous firing explosive is needed in addition to the gas generating agent, the enhancer and the igniter. The gas generating agent, the enhancer and the spontaneous firing explosive have different compositions respectively. Therefore, in order to produce the prior gas generator, process and factory must be provided to each of the gas generating agent, the enhancer and the spontaneous firing explosive although applied quantities of the enhancer and the spontaneous firing explosive are a very little in comparison with the gas generating agent. This is one of reasons of increasing a cost for producing the gas generator.

The present invention aims to solve the above said problems involved in the known gas generator including the above-mentioned known gas generating agent and enhancer. Specifically, the first aim of the present invention is providing enhancer having a function of spontaneously firing at a temperature which is lower than another temperature at which the housing of the gas generator deteriorates. The second aim of the present invention is provided an enhancer which enables a gas generating agent, especially having an organic type fuel as main ingredient, to ignite uniformly. The third aim of the present invention is providing enhancer of which composition can be also employed as a gas generating agent.

In other words, when an explosive composition having a function of spontaneously firing at a temperature which is lower than another temperature at which the housing of the gas generator deteriorates, is employed as an enhancer, further, when the spontaneous firing explosive composition is employed as a gas generating agent, it is not necessary to provide with different facilities respectively for producing the enhancer, the spontaneous firing explosive composition and the gas generating agent. Whereby, an inexpensive gas generator can be provided. In these views, intensive research and development work have been undertaken and resulted in the present invention which is disclosed hereinafter.

DISCLOSURE OF INVENTION

In order to achieve the aforesaid objects, the enhancer of the present invention is a mixture including a fuel ingredient, an oxidizing agent and a combution catalyst, which has a spontaneous firing function. The fuel ingredient is a nitrogen atom-contained organic compound consisting of at least one kind selected from the group consisting of azodicarbonamide, carbohydrazide, dicyandiamide, aminotetrazole, aminoguanidine, triaminoguanidine nitrate, nitroguanidine, triazole, tetrazole, azobitetrazole, bitetrazole, and salts of those compounds. At least 50% by weight of nitrate is contained as the oxidizing agent. The combustion catalyst contains substance selected from the following groups of ① to ③.

① at least one kind selected from the group consisting of zirconium, hafnium, molybdenum, tungsten, manganese, nickel, iron and oxides and sulfides of those elements;

② at least one kind selected from the group consisting of carbon and phosphorus; and ③ a mixture of the above members ① and ②.

The aforementioned fuel ingredient is a gas-generating ingredient which burns and decomposes in order to produce gas. The oxidizing agent is a ingredient for helping the fuel ingredient to burn. And the combustion catalyst is a ingredient for adjusting the oxidizing reaction and the spontaneous firing temperature. By combining those ingredients, a spontaneous firing enhancer is produced with a high gasification percentage and good fuel-firing property.

As a binder for the particles of the enhancer mixture, it is desirable to employ at least one kind selected from the grops of ④ to ⑦:

④ hydrotalcite-type compound expressed by the following general formula:

$$[M^{2+}{}_{1-x}M^{3+}{}_{H}(OH)^{2}]^{X+}[A^{n-}{}_{x/n}.mH_2O]^{X-}$$

where $M^{2+}$ represents a bivalent metal such as $Mg^{2+}$, $Mn^{2+}$, $Fe^{2+}$, $Co^{2+}$, $Ni^{2+}$, $Cu^{2+}$ and $Zn^{2+}$;

$M^{3+}$ represents a trivalent metal such as $Al^{3+}$, $Fe^{3+}$, $Cr^{3+}$, $Co^{3+}$ and $In^{3+}$;

$A^{n-}$ represents an n-valence anion such as $OH^-$, $F^-$, $Cl^-$, $Br^-$, $NO_3^{31}$ , $CO_3^{2-}$, $SO_4^{2-}$, $Fe(CN)_6{}^{3-}$, $CH_3COO^-$, oxalate ion and salicylate ion; and x: $0<x\leqq 0.33$.

⑤ Acid clay or activated clay

⑥ Natural zeolite or artificial zeolite

⑦ A mixture of two or more kind selected from the group consisting of the preceding ④ to ⑥.

In the hydrotalcite-type compounds ④, hydrotalcite expressed by a chemical formula $Mg_6Al_2(OH_{16}CO_3.4H_2O$ or pyroaurite expressed by a chemical formula of $Mg_6Fe_2(OH)_{16}CO_3.4H_2O$ is the most preferable binders in consideration of all the factors including the binding property, slug formation and commercial availability. It is preferable that 2 to 30% by weight of the hydrotalcite-type compound is used in relation to the total weight of the enhancer, especially, 3 to 10% by weight. It is preferable that a 50% average particle diameter of a reference number is preferably set to be 30 $\mu$m or less.

The nitrates of alkali metals are preferable as the oxidizing agents. Preferably, the 50% average particle diameter of a reference number falls in the range of 5 to 80 $\mu$m.

The preferably quantity of the combustion catalyst is 10% by weight or less. The more preferable quantity falls in the range of 2% to 8% by weight. Preferably, the 50% average particle diameter of a reference number is 10 $\mu$m or less.

Furthermore, the enhancer of the present invention is granulated in a preferred embodiment. It is also preferable heat that the spontaneous firing temperature of the enhancer falls in the rang of 150 to 180° C. in light of the gas generator having the aluminum housing.

The enhancer according to the present invention can be improved in aging characteristic or change of property with time when the granules of the enhancer are subjected to heat-treatment for 2 to 24 hours at 100 to 120° C. after granulating. The granules treated by heat shows a good stability during thermal aging resistance test for 400 hours at 107° C. It is noted that the heat-treatment is insufficient when the heat-treatment time is shorter than two hours. There is no difference between 24 hours and more in effect even when the heat-treatment time is longer than 24 hours. Therefore, heat-treatment time should be selected from the range of 2 to 24 hours, more preferably 5 to 20 hours. An effect of the heat-treatment is a little when a temperature for heat-treatment is 100° C. or less. Also, an adverse effect may be given when exceeding 120° C. On that ground, the temperature of heat-treatment should be selected from the range of 100 to 120° C., more preferably from 105 and 115° C.

Further, the aforesaid enhancer composition can be used as the gas generating agent. When the binder as shown in ④–⑦ is employed, each pellet of the gas generating agent has a high strength even though pellets are formed under a low pelletizing pressure.

The gas generator of the present invention has a housing provided with outlets for discharging gas, a gas generating agent, an igniter and an enhancer which is ignited by the igniter then fires the gas generating agent. And further, the gas generator of the present invention applies the aforesaid enhancer composition to the enhancer and/or the gas generating agent. When an explosive composition is common to the enhancer and the gas generating agent, processes for producing an explosive composition to be contained in the gas generator housing are rationalized.

BRIEF DESCRIPTION OF THE DRAWINGS

FIG. 3 is a table showing 40 cc-tank test results;

FIG. 5 is a table showing the reslts of 60-liter tank tests carried out in Embodiment 2 in which the condition of combustion was observed along the P-t curve;

FIG. 7 is a table showing the results of 60-liter tank tests carried out in Embodiment 4;

FIG. 9 is a table showing the result of a firing waiting time test conducted in Embodiment 5;

FIG. 10 is a table showing the results of a bon-fire test in Embodiment 6.

BEST MODE FOR CARRYING OUT THE INVENTION

Figure 1:
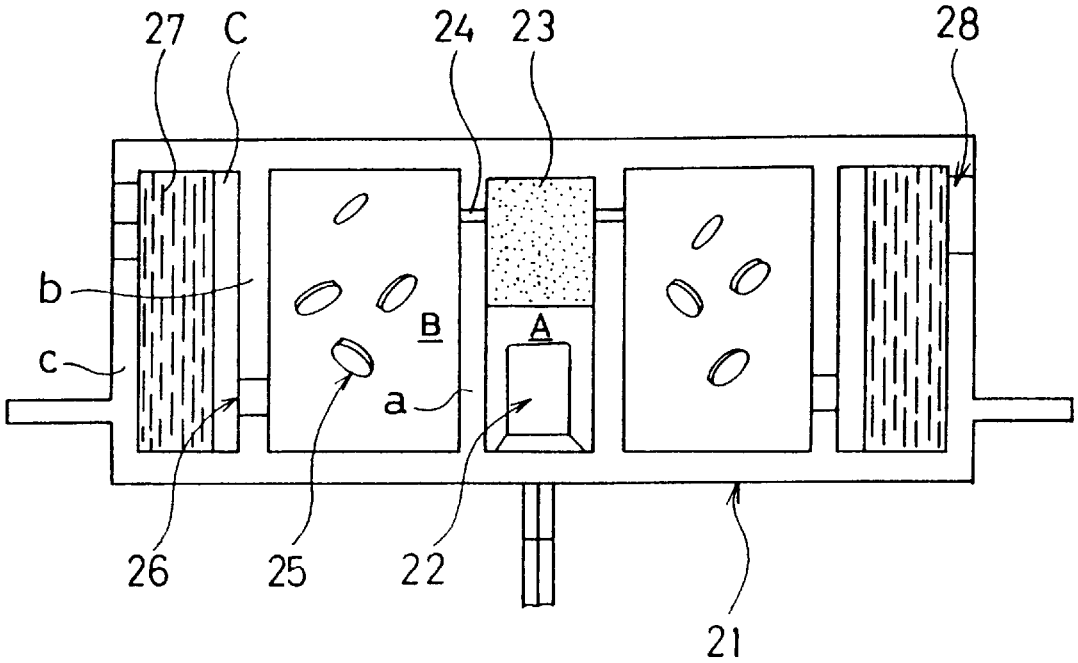
FIG. 1 is a schematic sectional view of the gas generator of the present invention.

Embodiments of the present invention will now be described in detail with reference to the drawings and examples. FIG. 1 is a schematic sectional view of one gas generator of the present invention.

The gas generator shown in FIG. 1 is partitioned into an inner most ignition chamber A, an intermediate combustion chamber B and an outer most filter chamber by an inner cylinder wall a, an intermediate cylinder wall b and an outer cylinder wall c. An igniter 22 and an enhancer 23 are disposed in the ignition chamber A. The igniter 22 sparks to be energized by the signal from a crash sensor (not shown in the drawing) and the enhancer 23 is ignited by the igniter 22. A high temperature gas generated by the combustion of the enhancer bursts into the combstion chamber B through the first gas holes 24*a* formed on the inner cylinder wall a then fires the gas generating agent 25 placed therein. A gas produced by the combustion of the gas generatng agent 25 bursts into the filter chamber C through the second holes 26 formed on the intermediate cylinder wall b. In the filter chamber C, the slug contained in the gas is removed from the gas and the gas is cooled by the filter 27. The gas is discharged towards an airbag (not shown in the drawing) through the third holes 28 formed on the outer cylinder wall c.

In the present invention, a mixture of ingredients selected from each following group (a)–(c), is employed as the explosive composition for the enhancer. The one or more ingredients may be selected from the each following group (a)–(c). It is noted that this explosive composition also can be used as the gas generating agent.

(a) Fuel ingredient group consisting of azodicarbonamide, carbohydrazide, dicyandiamide, aminotetrazole, aminoguanidine, triaminguanidine nitrate, nitroguanidine, triazole, tetrazole, azobitetrazole, bitetrazole, and salts of those compounds, which are organic compounds containing nitrogen atoms and produce gas including nitrogen gas as a main ingredient to decompose by combustion.

(b) Oxidizing agent for burning the fuel ingredient; and (c) Combustion catalyst for regulating the aforesaid oxidizing reaction.

Before mixing those explosive ingredients, it is desirable to adjust the particle size of each ingredient. Preferably, a 50% average particle diameters of a reference number of the fuel ingredient and the oxidizing agent are set to be 5 to 80 $\mu$m respectively. It is preferable that a 50% averagle particle diamter of a reference number of the combustion catalyst is 10 $\mu$m or less. When the 50% average particle diameters of a reference number of the fuel ingredient and the oxidizing agent are smaller than that, the two ingredients are so close each other that the spontaneous firing temperature tends to be set low, also, the combustion velocity is so rapid that the gas generator may explode.

Further, when the 50% average particle diameters of a reference number of the fuel ingredient and the oxidizing agent are larger than that, the combustion velocity is so slow that the explosive ingredients may not be used as an enhancer. When the 50% average particle diameter of a reference number of the combustion catalyst is larger than that, a dispersion of the combustion catalyst among of the particles of fuel ingredient and the oxidizing agent is insufficient and the function for regulating the combustion does not work enough.

It is noted here that the 50% average particle diameter of a reference number is measured on the basis of a distribution of the particle diameter. In the distribution, the total number of particles is set to 100 and the numbers of particles corresponding to each particle diaemter are plotted. The particle diaemter at a reaching point in the distribution of the particle diameter is regarded as the 50% average particle diameter of a reference number. The reaching point is the point where the number of particles reaches 50 to be summed up from a side of the smaller particle diameter till reaching to 50 number of particles.

It is preferable that 50% or more by weight of nitrate is contained as an oxidizing agent. Whereby, a produced amount of NOx included in the gas can be reduced.

In the suitable nitrate group, there are alkali metal nitrates such as potassium nitrate and sodium nitrate, alkaline earth metal nitrates such as magnesium nitrate and strontium nitrate and ammonium nitrate. Especially, alkali metal nitrates are more preferable.

Next, ingredients selected from the following groups ①–③ are employed as the combustion catalyst.

① At least one kind selected from the group consisting of zirconium, hafnium, molybdenum, tungsten, manganese, nickel, iron, their oxides and their sulfides, ② At least one kind selected from the group consisting of carbon and phosphorus, and ③ A mixture of aforesaid members ① and ②.

The above combustion catalyst has functions for regulating the velocity of oxidizing reaction (combustion) between the aforesaid oxidizing agent and the fuel ingredient which is organic compound containing nitrogen atoms, and for regulating spontaneous firing temperature. When a spontaneous firing explosive composition including the above combustion catalyst is employed as an enhancer, a spontaneous firing temperature of the enhancer can be adjusted so as to be spontaneously fired before the housing of the gas generator deteriorates, in other words, the spontaneous firing temperature can be set to 200° C. or less, more suitably, it can be set to 180° C. or less. And the gas generating agent is fired by the enhancer. Consequently, it is possible to prevent the housing from exploding. In order to ensure the safety yielded from the spontaneous firing function, it is preferable to set the spontaneous firing temperature between 150° C.–180° C. Whereby, it can be assured that the enhancer is fired then burns the gas generating agent before the aluminum housing of the gas generator deteriorates. Consequently, the safety of the gas generator can be secured. In the prior art, the gas generating agent is fired after a housing of the gas generator deteriorats under the high temperature environment such as a conflagration. Consequently, the housing of the gas generator explodes because of the burning gas generating agent. On the contrary, there is no problem such as the above in the present invention. The safety of the gas generator can be more secured in case of the emergency such as a conflagration.

It is preferable that the quantity of the combustion catalyst is set to 10% or less in relation to the total weight of the explosive composition so that an amount of the gas yield from the explosive composition may not be reduced and so that a large amount of the combustion slug may not be yield.

Since organic compounds are employed as fuel ingredinets in the enhancer of the present invention, a ratio of yielding the gas is about 55% which is larger than a prior art. For example, in one of the prior art, boron niter is employed as a fuel ingredient and a ratio of yielding the gas is about 10%. Therefore, the mechanism of firing the gas generating agent by this enhancer is basically different from that of the boron niter in which the gas generating agent is fired by heat particles. In the present invention, the enhancer generates a large quantity of high-temperature heat gas (presumably as high as 2,000° C.) which bursts into the combustion chamber a through the first holes 24 formed on the inner cylinder wall and covers all the surfaces of the gas generating agent pellets 25 in the combustion chamber. That triggers the processes of softening, melting, gasification and combustion reaction over the all surfaces of the gas generating agent pellets 25 almost simultaneously. Therefore, even when the packing density of the gas generating agent is high and passages of the firing energy (heat particles or heat gas) flow are narrow, as osmosis of the heat gas can be sufficient. When the gas generatng agent is packed to a high density, size and weight reductions of the gas generator can be achieved.

Next, when aforesaid explosive composition is applied to the enhancer, it is prferable that the explosive composition is granulated and the particle diameter is 1 mm or less. When aforesaid explosive composition is applied to the gas generating agent, it is preferable that the explosive composition is formed into one disk or a plurality of pellets having appropriate shapes and appropriate sizes. In the present invention, it is preferable that the explosive composition is formed with at least one binder selected from the following groups ④–⑦ in order to obtain a high-strength:

④ hydrotalcite-type compounds expressed by the following general formula:

$$[M^{2+}_{1-x}M^{s+}_{x}(OH)_2]^{X+}[A^{n-}_{x/n}\cdot mH_2O]^{x-}$$

where $M^{2+}$ represents a bivalent metal such as $Mg^{2+}$, $Mn^{2+}$, $Fe^{2+}$, $Co^{2+}$, $Ni^{2+}$, $Cu^{2+}$ and $Zn^{2+}$;

$M^{s+}$ represents a trivalent metal such as $Al^{3+}$, $Fe^{s+}$, $Cr^{3+}$, and $In^{3+}$;

$A^{n-}$ represents an n-valence anion such as $Oh^-$, $F^-$, $Cl^-$, $Br^-$, $CO_3^{2-}$, $SO_4^{2-}$, $Fe(CN)_6^{3-}$, $CH_3COO^-$, oxalate ion and salicylate ion; and x: $0<x\leqq 0.33$.

⑤ Acid clay or activated clay

⑥ Natural zeolite or artificial zeolite

⑦ A mixture of two or more selected from the group consisting of the preceding ④ to ⑥.

In the hydrotalcite-type compounds ④, hydrotalcite expressed by a chemical formula $Mg_6Al_2(OH_{16}CO_3.4H_2O$ or pyroaurite expressed by a chemical formula of $Mg_6Fe_2(OH)_{16}CO_3\cdot 4H_2O$ is the most preferable binders in consideration of all the factors including a binding property, a slug formation and a commercial availability.

These binders offer another advantage as follows. When the explosive composition with the above binders burns, the harmful fine particles produced by combustion, react with the metal oxides produced by the decomposition reaction of the binders, then slugs are formed. The slugs are easily removed by the filter.

These binders are contained by 2–30% by weight in relation to the total explosive composition. When an amount of the binders is less than 2% by weight, a binder function can not work. When the amount of the binders exceeds 30% by weight, an amount of other ingredients is reduced then an explosive function can not work. Therefore, it is preferable that 3–10% by weight of the binder is added.

The particle size of these binders is one of the important factors in the production technique. It is preferable that a 50% average particle diameter of a reference number is 30 μm or less in the present invention. When the particle diameter degree is larger than that, a function for binding each ingredients is reduced then a binding effect is a little. Therefore, a required strength concerning the formation body of the explosive composition can not obtained.

Further, in case of producing an enhancer employing the above explosive composition, ingredients selected from each aforesaid group such as the fuel ingredient (a), the oxidizing agent (b), the combustion catalyst (c) and the aforesaid binder are mixed after each ingredient is pulverized into particles having required particle diameters as described above. In case of necessity, organic or inorganic additive is further added. The mixture is granulated. It is preferable that the each granule diameter falls in a range of 0.3 to 1.00 mm since it is necessary that a burning velocity of the enhancer is more rapid than one of the gas generating agent. It is preferable that granules of the enhancer undergo such a heat treatment as has been described above.

Also, in case of producing a gas generating agent employing the above explosive composition, ingredients are mixed after pulverizing as described in case of the enhancer. The mixture is charged in a mold so as to be formed into a suitable shape by an ordinal press-forming. No limit is placed on a formable shape and size. In case of formed into pellets, the pellets can take various shapes and sizes. For example, a low height cylindrical shape, a sphere, an intermediate shape between the sphere and the low height cylindrical shape. When a low height cylindrical shape is employed, it is preferable that its diameter falls in a range of 5 to 8 mm and its thickness falls in a range of 2 to 4 mm. Also, it is possible to be formed into one disc of which diameter and thickness may be settled according to the size of the gas generator.

The formed body of the gas generating agent is subjected to a heat treatment for 2 to 24 hours at 100 to 120° C. after the forming process. And the resistance to change with time can be enhance. The formed body thus heat-treated shows a high degree of stability in a vigorous thermal aging resistance test for 400 hours at 107° C. It is noted that the heat treatment is insufficient when heat treatment time is shorter than two hours and there is not significant difference in an effect between under 24 hours and over even though the heat treatment time exceeds 24 hours. Therefore, the heat treatment time should be settled between 2 and 24 hours, more preferably 5 and 20 hours. In addition, there is little effect when a heat treatment temperature is 100° C. or less and a deterioration may occur when the heat treatment temperature exceeds over 100° C. On that ground, it is preferable that the temperature of heat treatment falls in a range of 100 to 120° C., more preferably 105–115° C.

Now, the present invention will be described concretely in embodiments.

[EMBODIMENT 1]

34.2% by weight of 5-amino-1H-tetrazol (5-ATZ) was prepared as the fuel ingredient to be pulverized into particles of which each diameter was 100 μm or less and a 50% average particle diameter of a reference number was 30 μm. 56.8% by weight of potassium nitrate was prepared as the oxidizing agent to be pulverized into particles of which each diameter was 100 μm or less and a 50% average particle diameter of a reference number was 55 μm. 4.5% by weight of $MoO_3$ was prepared as the combustion catalyst to be pulverized into particles of which each diameter was 30 μm or less and a 50% average particle diameter of a reference number was 2 μm. 4.5% by weight of synthetic hydrotalcite was prepared as the binder to be pulverized into particles of which each diameter was 50 μm or less and a 50% average particle diameter of a reference number was 10 μm. These ingredients were mixed well in a V-shaped mixer. The powdered mixture was stirred while spraying with water then formed into granules of which diameter is 0.5 mm. Thus an enhancer of the present invention was made. 1 [g] of the enhancer of the present invention and 1 [g] of the enhancer of the prior art were subject to a 40-cc tank test.

Figure 2:
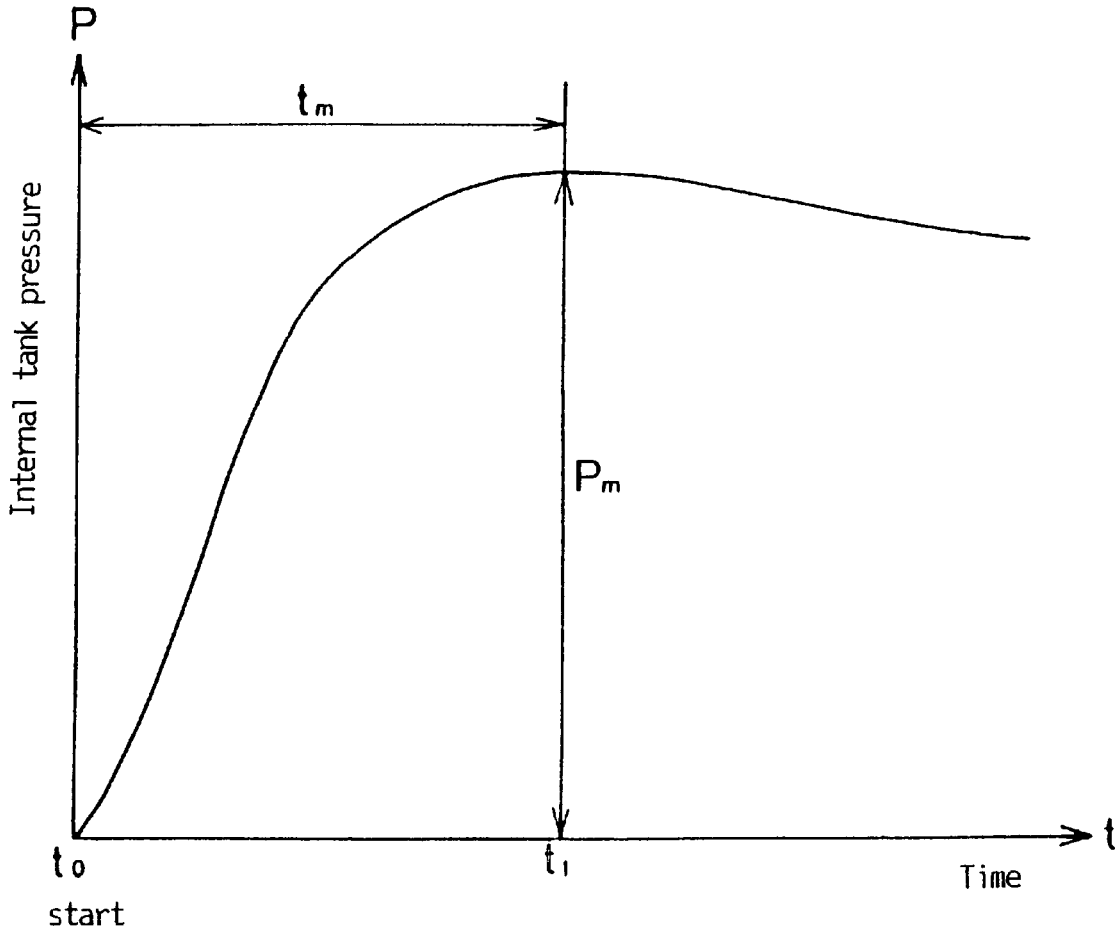
FIG. 2 is a conceptional P-t diagram showing tank test results.

This test was one for examining the power of the enhancer. 1 [g] of the enhancer is placed in the 40 cc-tank. The change concerning an internal pressure P of the tank is measured with time after ignition of the enhancer by a squib. A P-t diagram as shown in FIG. 2 is obtained. In FIG. 2, $t_0$ indicates the time of ignition by squib, $t_1$ indicates the time when the internal pressure reaches to a peak $P_m$, $t_m$ is the required time ($t_1$–$t_0$) for reaching to peak internal pressure $P_m$ from the time $t_0$. The results of the 40-cc tank test is summarized in FIG. 3. The exothermic values given in FIG. 3 were measured using a calorimeter.

As shown in FIG. 3, the enhancer of the present invention shows a high power (maximum pressure) even though exothermic value is low as compared with the conventional enhancer. This probable reason is that the gasification ratio in the prior art is 10% which is low, on the contrary the gasification ratio in the present invention is 55% which is high. Therefore, the enhancer of the present invention generates a large amount of high-temperature heat air. The heat air flows into the gas generating agent-packed portion quickly and fires the gas generating agent simultaneously.

There will now be described another embodiment in which an explosive composition is common to the enhancer and the gas generating agent.

[EMBODIMENT 2]

Figure 4:
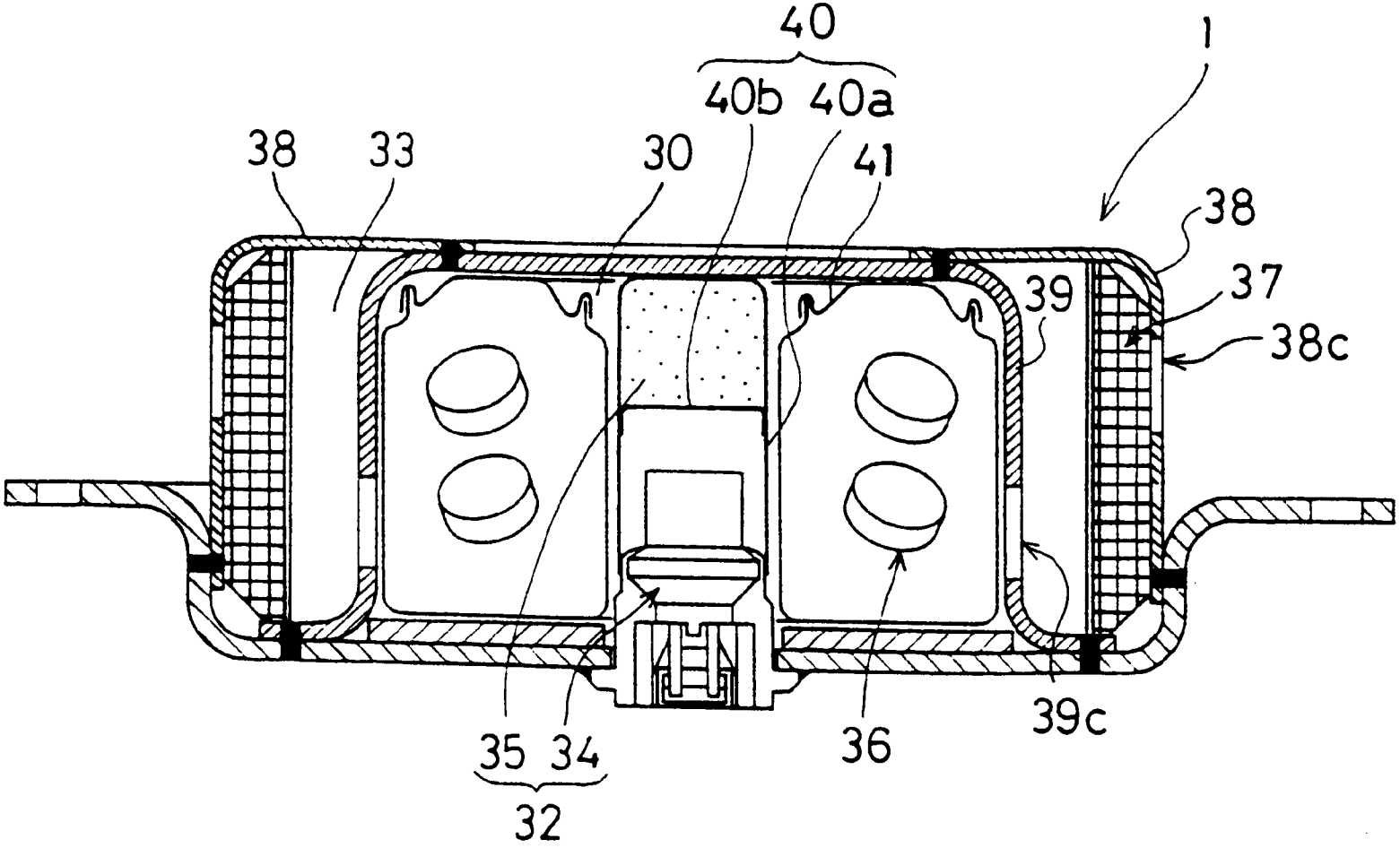
FIG. 4 is a schematic sectional view of another gas generator of the present invention used in Embodiment 2.

The construction of the gas generator used in the embodiment 2 is illustrated in FIG. 4. In FIG. 4, the reference number 30 indicates a combustion chamber containing pellets of the gas generating agent 36. The reference number 32 shows a firing means mounted in the center of the combustion chamber 30, which comprises a squib 34 and a enhancer 35 for firing the gas generating agent 36.

The reference number 33 is a filter chamber surrounding the combustion chamber annularly, which cools the gas passing through the combustion chamber 30 and collects the slug from the gas. Sparks from the squib 34 melt a container **40*b* made of aluminum foil then the enhancer 35 ignites. A high-temperature gas generated during the combustion of the enhancer bursts into the combustion chamber 30 to melt a container 41 made of aluminum foil for the gas generating agent in the combustion chamber 30 then fires the gas generating agent 36 in the combustion chamber 30. The gas produced during the combustion of the gas generating agent flows into the filter chamber 33 through first gas outlets 39*c* formed on the partition wall 39. In the filter chamber 33, the slug is removed from the produced gas while the produced gas is cooled. After that, the cooled gas is discharged from the second holes 38*c* provided on the outer wall 38** into an air bag (not shown in the figure).

The enhancer 35 and the gas generating agent 36 were made of the same explosive composition by the following manner.

(One explosive composition)

34.2% by weight of 5-amino-1H-tetrazol (5-ATZ) was prepared as the fuel ingredient to be pulverized into particles of which each diameter was 100 μm or less and a 50% average particle diameter of a reference number was 30 μm. 56.8% by weight of potassium nitrate was prepared as the oxidizing agent to be pulverized into particles of which each diameter was 100 μm or less and a 50% average particle diameter of a reference number was 55 μm. 4.5% by weight of $MoO_3$ was prepared as the combustion catalyst to be pulverized into particles of which each diameter was 30 μm or less and a 50% average particle diameter of a reference number was 2 μm. 4.5% by weight of synthetic hydrotalcite was prepared as the binder to be pulverized into particles of which each diameter was 50 μm or less and a 50% average particle diameter of a reference number was 10 μm. These ingredients were mixed well in a V-shaped mixer. In order to obtain pellets of the gas generating agent, one piece of the mixture was filled into a reference mold then press-formed into the pellets. Each pellet shape had a low height cylindrical shape of which diameter was 7 mm, thickness was 4 mm and weight was about 250 mg. In order to obtain granules of the enhancer, other piece of the mixture was granulated. Each granule had a diameter of 0.5 mm.

(Other explosive composition)

Separately, other enhancer and other gas generating agent were prepared in the following process. 42.3% by weight of 5-amino tetrazole potassium salt (K-5ATZ) was prepared as the fuel ingredient to be pulverized into particles of which each diameter was 100 μm or less and a 50% average particle diameter of a reference number was 30 μm. 48.7% by weight of potassium nitrate was prepared as the oxidizing agent to be pulverized into particles of which each diameter was 100 μm or less and a 50% average particle diameter of a reference number was 50 μm. 4.5% by weight of $Fe_2O_3$ was prepared as the combustion catalyst to be pulverized into particles of which each diameter was 30 μm or less and a 50% average particle diameter of a reference number was 2 μm. 4.5% by weight of acid clay was prepared as the binder to be pulverized into particles of which each diameter was 50 μm or less and a 50% average particle diameter of a reference number was 10 $\mu$m. These ingredients were mixed well in a V-shaped mixer. In order to obtain pellets of the gas generating agent, one piece of the mixture was filled into a reference mold then press-formed into the pellets. Each pellet shape had a low height cylindrical shape of which diameter was 7 mm, thickness was 4 mm and weight was about 250 mg. In order to obtain granules of the enhancer, other piece of the mixture was granulated. Each granule had a diameter of 0.5 mm.

The enhancer and the gas generating agent which had the same explosive composition each other, were packed in the gas generator as shown in FIG. 4. The gas generator packed with the enhancer and the gas generating agent was subject to the 60-liter tank test in order to examine the ability of the gas generator. The 60-liter tank had been constructed so that the inside temperature could be raised up to about 250° C. And two kind of the gas generators had been built to each kind of aforementioned explosive composition, one was provided with the first gas outlets 39*c* having a total opening area of 200 $mm^2$ and the other was provided with the first gas outlets 39*c* having a total opening area of 400 $mm^2$. In the 60-liter tank test, the above-mentioned gas generators were mounted in the hermetical closed 60-liter tanks respectively then activated. And the change concerning an internal pressure P of the each tank was measured with time t, from which a P-t diagram as shown in FIG. 2 was obtained as well as [EMBODIMENT 1]. In this case, $t_0$ indicates the time when the gas generator starts activation, $t_1$ indicates the time when the internal pressure reaches to a peak $P_m$, $t_m$ is the required time ($t_1-t_0$) for reaching to the peak internal pressure $P_m$ from the time $t_0$. In the P-t diagram, a combustion velocity is rapid when a curve indicating the pressure P rises sharply, and the gas generator may explode when the maximum pressure $P_m$ is too high. Also, when $t_m$ is too long, it takes long time to inflate the air bag. The air bag must be instantaneously inflated, therefore the explosive composition having too long $t_m$ is not suitable for the gas generating agent for inflating the air bag. Even though the desired values of $P_m$ and $t_m$ depend on the size, the arranged position, the use of air bags (for the driver, for the passenger, for a side crash accident, or the like) and the car model (passenger car, bus, truck or other vehicles), it is desirable that $P_m$ falls in the range of 150 to 250 kPa and $t_m$ is 150 ms or less.

In the 60-liter tank test, the combustion condition was examined as well as the P-t curve. The test results are shown in FIG. 5.

As shown in FIG. 5, the attained maximum pressures $P_m$ were appropriately high and the required times $t_m$ for reaching the maximum pressures $P_m$ were appropriately short in all the tests. These show that the combustions have gone on safely and smoothly. From the result of the 60-liter tank test, it is realized that the enhancer of the present invention fires the gas generating agent extremely smoothly.

[EMBODIMENT 3]

Figure 6:
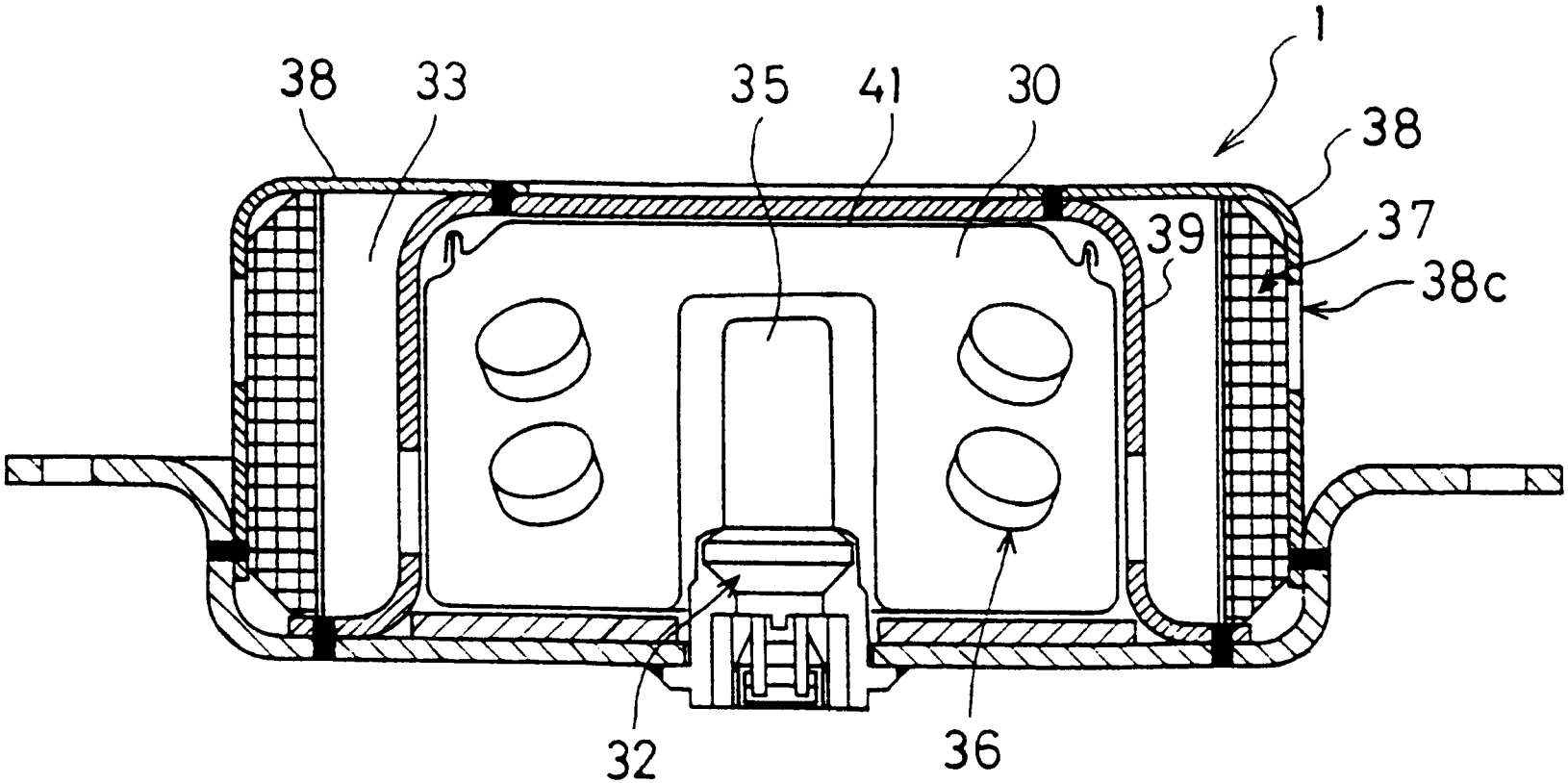
FIG. 6 is a schematic sectional view of still another gas generator of the present invention used in Embodiment 3.

An embodiment of a gas generator having the construction illustrated in FIG. 6 will now be described. This gas generator in FIG. 6 has structual differences from the gas generator in FIG. 4 as follows. In FIG. 6, an integral-type igniter 32 is employed in which an enhancer 35 is incorporated in the igniter 32. The annular aluminum foil container 41 has a portion which can communicate in the radial direction at its upper side, which is disposed in an annular combustion chamber 30 formed in the space between the igniter 32 and a partition wall 39. The gas generating agent 36 is contained in the container 41. An explosive composition employed as an enhancer and a gas generating agent is the same one as employed in the embodiment 2. Combustion tests using the gas generator of Embodiment 3 were done in the same manner as Embodiment 2. Satisfactory results were obtained as well as in Embodiment 2. Especially, in Embodiment 3, a holder for the enhancer as shown in the prior art is not necessary. The construction of the gas generator can be simplified by this reduction concerning the number of the parts. This will help to reduce a cost of production.

[EMBODIMENT 4]

A case in which explosive compositions of the enhancer and the gas generating agent are different from each other, will be described hereinafter.

36.2% by weight of 5-amino-1H-tetrazol (5-ATZ) was prepared as the fuel ingredient to be pulverized into particles of which each diameter was 100 $\mu$m or less and a 50% average particle diameter of a reference number was 30 $\mu$m. 59.3% by weight of strontium nitrate was prepared as the oxidizing agent to be pulverized into particles of which each diameter was 100 $\mu$m or less and a 50% average particle diameter of a reference number was 45 $\mu$m. 4.5% by weight of synthetic hydrotalcite was prepared as the binder to be pulverized into particles of which each diameter was 50 $\mu$m or less and a 50% average particle diameter of a reference number was 10 $\mu$m. These ingredients were mixed well in a V-shaped mixer. In order to obtain pellets of the gas generating agent, the mixture was filled into a reference mold then press-formed into the pellets. Each pellet shape had a low height cylindrical shape of which diameter was 7 mm, thickness was 4 mm and weight was about 250 mg. This gas generating agent has no spontaneous firing function since no combustion catalyst is contained.

Then, the same enhancer as is prepared in Embodiment 1 and the gas generating agent obtained as above were loaded in a gas generator illustrated in FIG. 4. The gas generator underwent the same 60-liter tank test as in Embodiment 2. The test results are given in FIG. 7.

As clearly understood from FIG. 7, the present invention gave good gas generator characteristics in combination with another organic type of gas generating agent having no spontaneous firing function.

[EMBODIMENT 5]

Firing waiting tests as follows, were carried out in order to examine the spontaneous firing functions of the explosive compositions.

Figure 8:
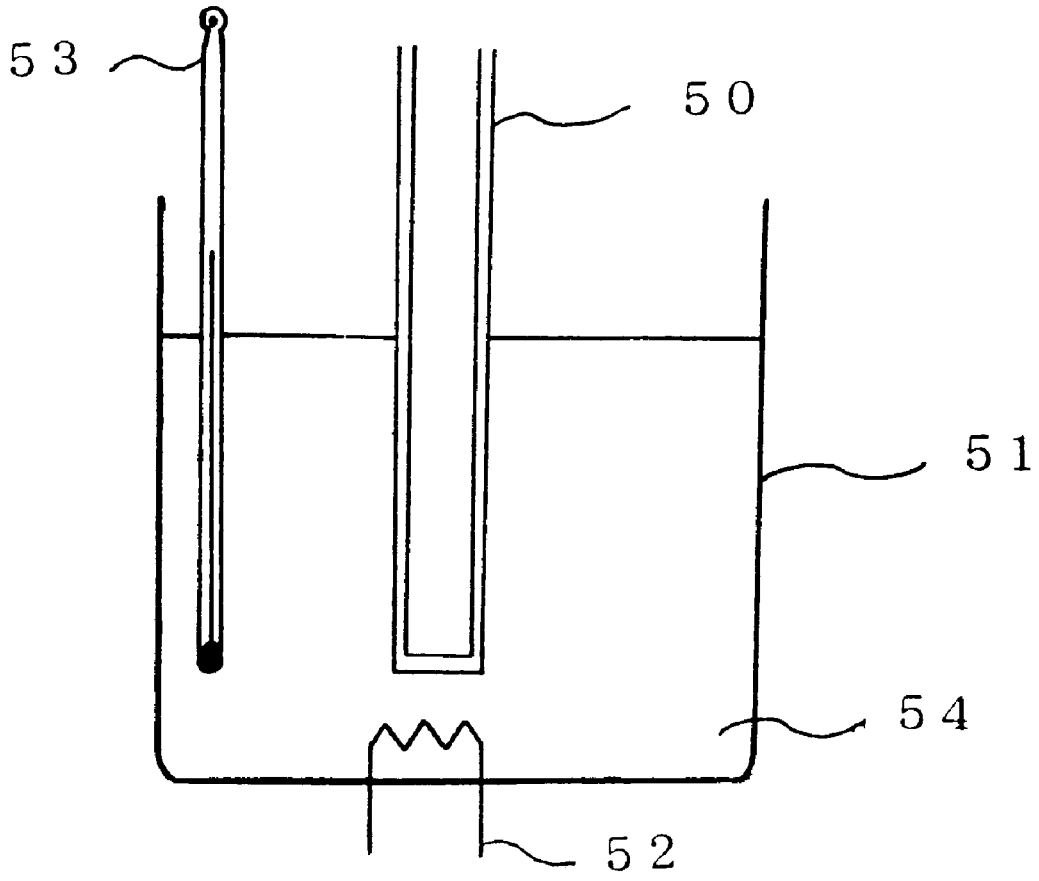
FIG. 8 shows the testing apparatus used in a firing waiting time test performed in Embodiment 5.
Figure 11:
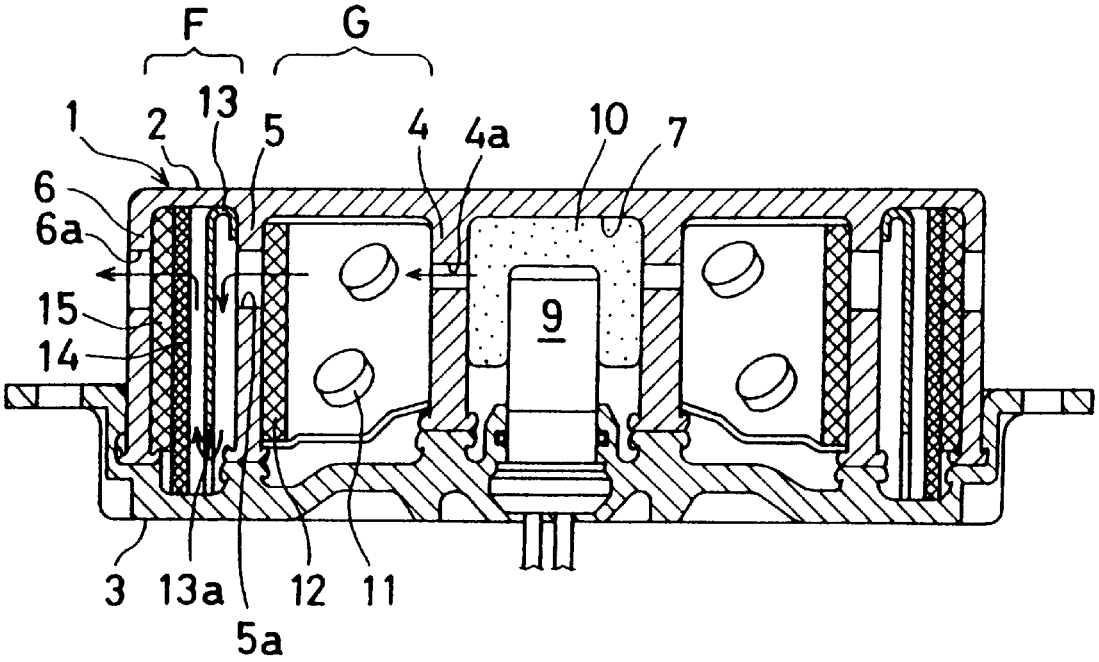
FIG. 11 is a schematic sectional view of the prior art gas generator.

As shown in FIG. 8, an oil bath 51 with an automatic temperature control was filled with silicone oil 54 and was provided with an iron cylinder 50 of which an inside diameter is 2 cm and a length is 20 cm. The temperature was maintained at 182.5±2.5° C. by a heater 52 and a thermometer 53. Then 0.1±0.01 [g] of the explosive composition was placed in the iron cylinder 50. And the required time to be spontaneously fired or to make spontaneous firing sound was measured. When the spontaneous fire or the spontaneous firing sound of an explosive composition was measured within 3 minutes, it was estimated that the explosive composition had a spontaneous firing function. Each explosive composition was tested three times. The test results are summarized in FIG. 9.

As clearly understood from FIG. 9, the explosive compositions of the present invention was fired at about 180° C. within 3 minutes. $BKNO_3$ of the prior art and the explosive composition containing no combustion catalyst were not fired. The firing waiting times of the test No. 02 ($MoO_3$ used) and the test No. 04 ($Fe_2O_3$ used) were different form each other since spontaneous firing temperatures depended on various kind of combustion catalyst.

[EMBODIMENT 6]

The enhancer of the present invention and the gas generating agent were loaded in a gas generator as illustrated in FIG. 4. The gas generator underwent a bonfire test in order to examine the spontaneous firing function of the gas generator. The required time for firing the gas generator was measured. When the gas generator was fired within three minutes with no damage on the housing of the gas generator, it was estimated that the gas generator had a spontaneous firing function. The test results are shown in FIG. 10. Other enhancers and gas generating agents made of other explosive compositions than the present invention also underwent the test as the comparisons.

As clearly understood from FIG. 10, it was estimated that the gas generators of the present invention had spontaneous firing functions since they were fired within three minutes without no damage on the housings of them. The other hands, other enhancers and gas generating agents made of other explosive compositions than the present invention were fired with more than three minutes and with damages on the housings of them. This means that other explosive compositions than the present invention need additional ingredients having spontaneous firing function for preventing housings of their gas generator from damaging.

As described above, according to the enhancer of the present invention including the nitrogen atoms-contained organic compounds as fuel ingredients, the gas generating agent is simultaneously fired even when a packing density of the gas generating agent is high. Because a heat gas is generated during a combustion of the enhancer and permeates among of the pellets of the gas generating agent then the gas generating agent is simultaneously fired. This is different from the prior art of firing with heat particles of boron niter. Consequently, the packing density concerning the pellets of the gas generating agent becomes higher than one of the prior art and the reductions concerning a size and a weight of the gas generator can be achieved.

In case of the gas generating agent including the nitrogen atoms-contained organic compounds, the gas generating agent burns through the processes of softening, melting, vaporization and reaction (combustion). In the present invention, heat required to the processes can be continuously supplied from the surroundings since the processes of softening, melting, vaporization proceed under a heat gaseous atmosphere, which are endothermic processes. Therefore, these processes proceed without interruption and the gas generating agent is fired and burns smoothly. From these views, we can say that the enhancer of the present invention possesses the most suitable characteristics of igniting the gas generating agent of the organic type.

Further, according to the present invention, the quantity of solid products produced from the enhancer is less and the exothermic value is lower than the prior art. The exothermic value of the present invention is 3.4 kJ/g while one of the prior art including boron niter is 4.6 kJ/g. Furthermore, the gas bursting into the air bag is clean since the present invention uses such binders as hydrotalcite-type compounds yielding the slugs which are easily collected.

Also, according to the present invention, in emergencies like a configuration, the enhancer is spontaneously fired then ignites the gas generating agent before the deterioration of the gas generator housing since the enhancer of the present invention has a function of being spontaneously fired at the temperature of 180° C. or less which is lower than the heat deterioration temperature of the aluminum housing. Therefore, it is possible to prevent the housing from exploding. Consequently, in the present invention, it is not necessary that additional explosive composition which has a spontaneous firing function is arranged in the gas generator, and the construction of the gas generator can be simplified in comparison with the prior art.

Still another advantage is that the enhancer of the present invention can be easily and safely handled since there is little fear of the enhancer ignited by impact in comparison with the prior art of boron niter.

It is further noted that the enhancer composition of the present invention can be also used as a gas generating agent. Therefore, when the enhancer composition of the present invention is employed as both the enhancer and the gas generating agent, processes for producing the the enhancer and the gas generating agent become common to them. This enables the processes for producing explosive compositions to be mounted in the gas generator to to be simplified and enables the product cost to be reduced.

Also, according to the present invention explosive composition, a ratio of yielding the gas is about 55% which is larger than a prior art. Therefore, when the explosive composition of the present invention is employed as a gas generating agent, a quantity of the gas generating agent can be reduced and reductions concerning size and wight of the gas generator can be brought.

INDUSTRIAL APPLICABILITY

The enhancer of the present is suitable as a enhancer for use in a gas generator to inflate an air bag for protecting the occupant in a vehicle. Specifically, the enhancer of the present is suitable as a enhancer having a function of spontaneously firing at a temperature which is lower than another temperature at which the housing of the gas generator deteriorates. Further, the enhancer of the present is suitable as a enhancer which enables a gas generating agent, especially having an organic type fuel as main ingredient, to ignite uniformly.

The gas generator of the present invention is suitable as a gas generator able to be inexpensively produced. Because the gas generator of the present invention employs the above enhancer composition, having the spontaneous firing function, as both the enhancer and the gas generator, consequently, there is no necessity of providing with different facilities respectively for producing the enhancer, the spontaneous firing explosive composition and the gas generating agent.

What is claimed is:

1. A spontaneous firing explosive composition for use in a gas generator for an air bag, comprising:

a fuel, an oxidizer, a combustion modifier and 2–30% by weight of a binder, wherein said binder has 30 $\mu$m or less of a 50% average particle diameter of a reference number and the above agents are mixed, and said fuel is at least one nitrogen atom-containing organic compound selected from the group consisting of azodicarbonamide, carbohydrazide, dicyandiamide, aminotetrazole, aminoguanidine, triaminoguanidine nitrate, nitroguanidine, triazole, tetrazole, azobitetrazole, bitetrazole, and salts thereof, said oxidizer contains at least 50% by weight of potassium nitrate, said combustion modifier is selected from the following groups (1)–(3):

(1) at least one member selected from the group consisting of zirconium, hafnium, molybdenum, tungsten, manganese, nickel, iron and oxides and sulfides of those members, (2) at least one member selected from the group consisting of carbon and phosphorus, and (3) a mixture of the above members (1) and (2), said binder, which binds said fuel, oxidizer and combustion modifier, is at least one member selected from the following groups i)–iv):

i) hydrotalcite-type compound having the formula:

$$[M^{2+}_{1-x}M^{3+}_{x}(OH)_2]^{x+}[A^{n-}_{x/n}\cdot mH_2O]^{x-}$$

where $M^{2+}$ is a bivalent metal selected from the group consisting of $Mg^{2+}$, $Mn^{2+}$, $Fe^{2+}$, $Co^{2+}$, $Ni^{2+}$, $Cu^{2+}$ and $Zn^{2+}$;

$M^{3+}$ is a trivalent metal selected from the group consisting of $Al^{3+}$, $Fe^{3+}$, $Cr^{3+}$, $Co^{3+}$, and $In^{3+}$;

$A^{n-}$ is an n-valence anion selected from the group consisting of $OH^-$, $F^-$, $Cl^-$, $Br^-$, $NO_3^-$, $CO_3^{2-}$, $SO_4^{2-}$, $Fe(CN)_b^{3-}$, $CH_3COO^-$, oxalate ion and salicylate ion; and x: $0<x\leqq 0.33$, ii) Acid clay or activated clay iii) Natural zeolite or artificial zeolite iv) A mixture of two or more members selected from the group consisting of the preceding groups i)–iii).

2. The spontaneous firing explosive composition as set forth in claim 1, wherein said binder is selected from the group consisting of hydrotalcite having a formula $Mg_6Al_2(OH)_{16}CO_3\cdot 4H_2O$, pyroaurite having a formula of $Mg_6Fe_2(OH)_{16}CO_3\cdot 4H_2O$ and a mixture thereof.

3. The spontaneous firing explosive composition as set forth in claim 1, wherein said fuel is aminotetrazole.

4. The spontaneous firing explosive composition set forth in claim 1, wherein said combustion modifier is molybdenum or an oxide thereof.

5. The spontaneous firing explosive composition as set forth in claim 1, wherein a 50% average particle diameter of a reference number of said potassium nitrate is 5–80 $\mu$m.

6. The spontaneous firing explosive composition as set forth in claim 1, wherein said combustion modifier is present in an amount of 2–10% by weight.

7. The spontaneous firing explosive composition as set forth in claim 1, wherein a 50% average particle diameter of a reference number of said combustion modifier is 10 $\mu$m or less.

8. The spontaneous firing explosive composition as set forth in claim 1, wherein said explosive composition is granulated.

9. The spontaneous firing explosive composition as set forth in claim 1, wherein a spontaneous firing temperature of said explosive composition falls in the range of 150 to 180° C.

10. An enhancer comprising said spontaneous firing explosive composition as set forth in any one of claims 1 to 9.

11. A gas generating agent comprising said spontaneous firing explosive composition as set forth in any one of claims 1 to 9.

12. A gas generator comprising said enhancer set forth in claim 10.

13. A gas generator for an air bag comprising said gas generating agent as set forth in claim 11.

14. The gas generator comprising an enhancer and a gas generating agent comprising said spontaneous firing explosive composition as set forth in any one of claims 1 or 9 wherein a composition of said enhancer is substantially the same composition as said gas generating agent.

* * * * *